US006209330B1

(12) United States Patent
Timmerman et al.

(10) Patent No.: US 6,209,330 B1
(45) Date of Patent: Apr. 3, 2001

(54) MODULAR AIR HANDLING SYSTEM AND METHOD FOR PROVIDING COOLING

(75) Inventors: George H. Timmerman, Phoenix; Ralph J. Cushing, Glendale, both of AZ (US); Bradley A. Weyeneth, Carlock, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/312,971

(22) Filed: May 17, 1999

(51) Int. Cl.[7] ..... F25D 17/00

(52) U.S. Cl. ..... 62/179; 62/89; 62/185; 62/186; 62/203; 62/237; 62/448

(58) Field of Search ..... 62/179, 448, 237, 62/203, 89, 229, 185, 186, 449, 450

(56) References Cited

U.S. PATENT DOCUMENTS

| | | | | |
|---|---|---|---|---|
| Re. 30,229 | | 3/1980 | Berman et al. | 290/1 R |
| Re. 30,280 | | 5/1980 | Berman et al. | 290/1 R |
| 2,240,377 | * | 4/1941 | Preble | 62/24 |
| 2,293,316 | * | 8/1942 | Stebbins | 257/18 |
| 2,914,927 | * | 12/1959 | Corhandis | 62/429 |
| 3,228,205 | * | 1/1966 | Franklin | 62/237 |
| 3,712,078 | * | 1/1973 | Maynard et al. | 62/448 |
| 3,777,506 | * | 12/1973 | Hergatt et al. | 62/237 |
| 3,925,679 | | 12/1975 | Berman et al. | 290/1 |
| 4,042,016 | | 8/1977 | Boochever et al. | 165/20 |
| 4,118,945 | | 10/1978 | Boochever et al. | 62/176 |
| 4,242,847 | | 1/1981 | Rezin | 52/169 |
| 4,270,362 | | 6/1981 | Lancia et al. | 62/173 |
| 4,271,678 | | 6/1981 | Liebert | 62/173 |
| 4,462,460 | * | 7/1984 | Braver | 165/26 |
| 4,549,405 | * | 10/1985 | Anderson et al. | 62/239 |
| 4,606,198 | | 8/1986 | Latshaw et al. | 62/205 |
| 4,835,977 | * | 6/1989 | Haglund et al. | 62/89 |
| 4,852,362 | * | 8/1989 | Conry | 62/175 |
| 4,878,357 | | 11/1989 | Sekigami et al. | 62/160 |
| 4,901,538 | * | 2/1990 | Anthony | 62/237 |
| 4,912,940 | * | 4/1990 | Anderson et al. | 62/239 |
| 4,992,669 | | 2/1991 | Parmley | 290/1 R |
| 5,177,972 | | 1/1993 | Sillato et al. | 62/205 |
| 5,245,838 | * | 9/1993 | Cavalea, III | 62/259.1 |
| 5,315,794 | | 5/1994 | Pearson | 52/79.1 |
| 5,383,335 | * | 1/1995 | Anderson et al. | 62/89 |
| 5,406,807 | | 4/1995 | Ashiwake et al. | 62/376 |
| 5,467,609 | * | 11/1995 | Feeney | 62/259.2 |
| 5,575,594 | | 11/1996 | Kurtz et al. | 405/303 |
| 5,666,813 | | 9/1997 | Brune | 62/90 |
| 5,960,638 | * | 10/1999 | McCabe et al. | 62/90 |

* cited by examiner

*Primary Examiner*—William Doerrler
*Assistant Examiner*—Marc Norman
(74) *Attorney, Agent, or Firm*—Howard & Howard

(57) ABSTRACT

A modular air handling supply system and method for producing a supply of cooled air for cooling purposes is disclosed. The modular air handling supply system includes a module container and ducting for transporting the air within said module container and a blower in operational connection with the ducting, wherein the cooled air is propelled to at least one resource or facility, each of which are located external to the module container. The system has the capability of supplying a remote resource or facility with a variable volume and temperature of cooled air.

29 Claims, 1 Drawing Sheet

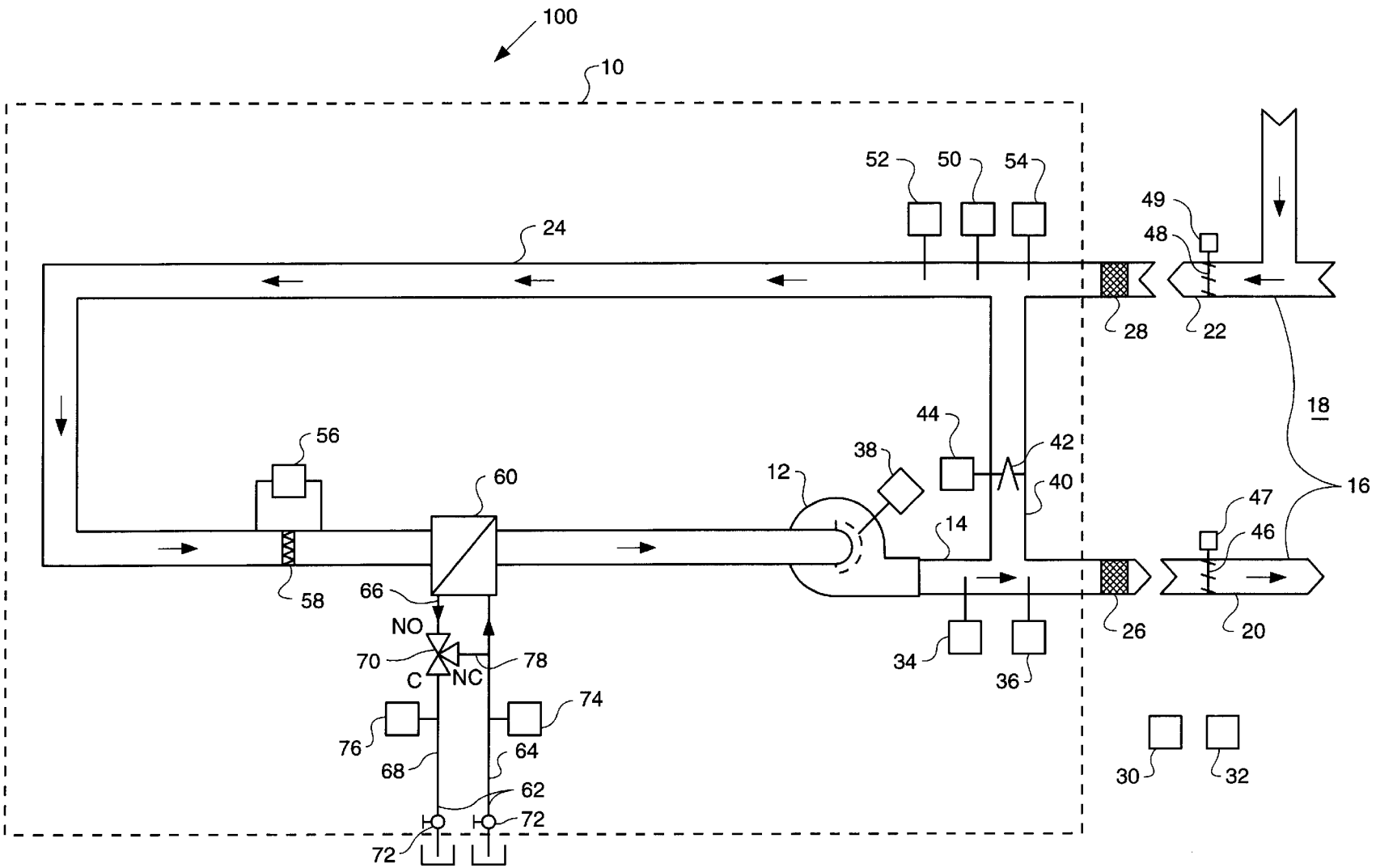
100
10
12
14
16
18
20
22
24
26
28
30
32
34
36
38
40
42
44
46
47
48
49
50
52
54
56
58
60
62
64
66
68
70
72
74
76
78
NO
NC
C

MODULAR AIR HANDLING SYSTEM AND METHOD FOR PROVIDING COOLING

TECHNICAL FIELD

This invention relates generally to air handling systems and, more particularly, to a modular cooling system for conditioning air while utilizing an existing chilled water supply. Though not limited thereto, the present invention is particularly useful in connection with large computer installations which require a continuous or near-continuous supply of conditioned air for reliable operation.

BACKGROUND ART

Individuals, businesses, and governments have grown increasingly dependent on the services and resources that are made available through the processing of computers and computerized control facilities. In spite of the explosive growth in the utilization of control circuits and personal computers in recent years, many computer applications continue to rely on the services provided by large computer mainframe installations. Such data processing facilities are often in continuous operation, twenty-four hours per day, three hundred and sixty-five days a year.

The computer equipment typically found in mainframe computer rooms generates vast amounts of heat and requires a limited temperature environment in which to operate reliably. In addition, a continuous supply of clean air is necessary to prevent the buildup of dust or dirt, which could contaminate the electrical circuits and compromise the reliable operation of the equipment.

While the thousands of mainframe computer installations in continuous operation throughout the world attest to the fact that many data processing facilities have provided at least basic cooling and filtration operations, problems still exist. In fact, HVAC (heating, ventilating, air conditioning) systems have been designed and implemented for year-around operation, with energy conservation cycles to take advantage of lower ambient temperatures. Some of these systems are well known to be fully integrated systems that address the cooling and filtration requirements of electronic data processing and control equipment. However, such systems are designed and marketed in a finite number of configurations, such as in 5, 10, 15, etc. ton capacities. Because of the critical nature of the services and resources provided by mainframe data processing systems and because of the finite operating temperatures and humidity in which such equipment can operate reliably, HVAC systems supporting computer facilities have been designed with redundant components in the form of backup compressors, pumps, and fan motors. However, such redundancy raises both the cost and size of such equipment. Furthermore, not all key components in such systems are duplicated, and a failure of any of these elements results in the HVAC system operating at reduced capacity or even being shut down to await parts and repair by skilled personnel.

The present invention is directed to overcoming one or more of the problems set forth above.

DISCLOSURE OF THE INVENTION

In one aspect of this invention, a modular air handling system for producing a supply of cooled air for cooling purposes is disclosed. The modular air handling system includes a module container and a primary duct work mechanism for transporting the air within the module container and a blower module for propelling the air within the primary duct work mechanism, along with a cooling coil module located within the module container, wherein a variable volume and temperature of cooled air is propelled by the blower module to at least one resource that is located external to the module container.

In another aspect of the present invention, a method for producing a supply of cooled air to facilities external to a modular air handling system is disclosed. The method includes the steps of housing the primary air handling apparatus of a blower module, a cooling coil module, and a primary duct work mechanism within a module container and cooling a supply of air and propelling a variable volume and temperature of cooled air to at least one resource located external to the module container.

BRIEF DESCRIPTION OF THE DRAWING

For a better understanding of the present invention, reference may be made to the accompanying drawing in which:

FIG. 1 is a schematic diagram of a modular air handling system.

BEST MODE FOR CARRYING OUT THE INVENTION

Referring now to FIG. 1, an external structure for a module container 10 for enclosing the components of an air handling system on all sides, including a top and a bottom, is depicted. The entire air handling system, comprising the container structure, the interior components, and quick-connect couplings as more thoroughly disclosed below will collectively be referred to as the "modular air handling system" or "module", hereinafter depicted by numeral 100.

The aforementioned sides of the module container 10 may traditionally include four sides of a rectangular structure. However, the module container 10 could also be round or any other known design for enclosing a space for the housing of equipment. It is intended that the entire module 100, including the module container 10 and internal components and connections is designed and constructed such that it can be moved intact from point of manufacture to an end site and from site to site regardless of location of the site. Such a feature permits complete replacement of the entire module 100 as a unit should any component fail, should the site no longer require the cooling provided by the module 100, or should the site require a module 100 with more or less cooling capacity. As such, the module 100 may have external connections such as lifting brackets (not shown) to facilitate the moving and loading of the module 100 by crane or other lifting means. Additionally, the module 100 may have wheels, rollers, or similar devices (not shown) operably connected to the bottom or sides of the modular container 10 to facilitate its mobility. By way of illustrative example, the modular container 10 may have nominal dimensions of five feet (5') deep by seven feet (7') high by ten feet (10') in length. However, the dimensions of the modular container 10 are a function of the size and number of components contained within and are not intended to be limited by the exemplary dimensions disclosed above. Given the size of the module container 10, its containment components including top, bottom, and sides may also be described as ceiling, floor, and walls, respectively.

The primary operational component of module 100 is a blower 12. Although only one blower 12 is shown, any number of blowers may be designed into a comparably-sized module container 10 to provide desired cooling and air volume capacity. The blower 12 propels a supply of air through a supply duct 14 to a cool air loop 16 servicing a facility or equipment (not shown) located in a space 18 external to the module container 10. The cool air loop 16 includes a supply duct 20 and a return duct 22, supplying a remote space or equipment with cool air and returning that air to a return duct 24 in a relatively continuous cycle. The remote space or equipment may be located immediately adjacent to the module 100, in which case the supply duct 20 and the return duct 22 will be relatively short in length. Alternatively, the facility or equipment serviced by the modular air handling system 100 may be located some distance from the module 100, such as on a different floor within a building or in a building separate from the module 100 location. In such installations, the supply and return ducts 20 and 22, respectively, will be relatively long. The supply ducts 14 and 20 each terminate at the module container 10 with a quick-connect coupling 26. The return ducts 22 and 24 each terminate at the module container 10 with a quick-connect coupling 28. The quick-connect couplings 26 and 28 comprise flexible links and connect/disconnect the air ducts to facilitate the modular features of the inventive system by permitting rapid and convenient connection and disconnection of the module 100 from its surroundings by non-technical personnel, using non-specialized equipment.

The resources served by the module 100 may be open space occupied by people, equipment, or both (not shown), in which the module 100 provides cool air to control the temperature within the facility. The supply duct 14 may also provide a supply of cool air to a space beneath the raised floor of a computer room (not shown), thereby providing cooled air to the computer room equipment and space through vents in the raised floor. The temperature and air pressure in the space 18 is detected and reported by two sensors, 30 and 32, respectively. While not shown in FIG. 1, the system is intended to include any of the sensory systems typically associated with blowers, electric motors, air conditioning systems, fluid chilling systems, and air handling equipment. Such sensory systems, by way of example and not limitation, detect such conditions as power on/off, motor stopped, motor running, air temperature, presence of smoke, air flow, water temperature, water flow, air pressure, and malfunction.

Connected to the supply duct 14 on the outlet side of the blower 12 is a sensor 34 for detecting and reporting the temperature of the air supply exiting the blower 12. The sensor 34 may be connected to a display panel (not shown) as more thoroughly disclosed below. An abnormally high reading by the sensor 34 may indicate a malfunction somewhere in the modular air handling system 100 or may indicate a malfunction or excessive heat in the facility serviced by the module 100, and a corresponding alarm indication may be signaled as discussed below. Also connected to the supply duct 14 on the outlet side of the blower 12 is a sensor 36 for detecting and reporting any smoke in the air flow exiting the blower 12.

The blower 12 is equipped with a variable volume control 38, thereby controlling the volume of air propelled by the blower 12 through the supply duct 14 into the external space 18. The variable volume control 38 may be a variable speed control for the blower 12, with a slower blower speed resulting in a lesser volume of air propelled by the blower 12 into the cool air loop 16. Alternatively, the control 38 may be a scroll cone volume control, thereby directly controlling the volume of air propelled through the supply duct 14 by the blower 12. The volume of air propelled through the supply duct 14 to the external space 18 may also be controlled with a bypass feature that includes a bypass duct 40 that is connected between the supply duct 14 and the return duct 24. Within the bypass duct 40 is a vane 42, controlled with a bypass volume control 44. As less cool air is required by the space 18, the vane 42 is opened by operation of the bypass volume control 44, thereby causing part of the air flow exiting the blower 12 to be routed through the bypass duct 40 and reducing the volume of air passing through the supply duct 14 into the supply duct 20 to service the space 18

Air from the space 18 is drawn into the module 100 and into the return duct 24 from the return duct 22 through the quick-connect coupling 28 by the suction action of the blower 12. The temperature and humidity of the return air in the return duct 24 are detected and reported by the two sensors 50 and 52, respectively. A sensor 54 detects and reports any smoke in the air flow in the return duct 24. Should either of the sensors 36 or 54 detect the presence of smoke, the system will activate the shut-down and isolation of the modular air handling system 100 by shutting off blower 12 and directing the damper controls 47 and 49 to close vanes 46 and 48 located in supply duct 20 and return duct 22, respectively. The supply and return duct shut-off vanes 46 and 48, in addition to isolating the module 100 upon detection of smoke, may be utilized to isolate the modular air handling system 100 for repair or replacement without jeopardizing the supply of cooled air to the space 18. Providing reliable and redundant cooling systems to critical facilities or equipment located in a space 18 may require multiple modular air handling systems 100. While only one such module 100 is shown in FIG. 1, any number of modules 100 may be connected in parallel to serve a given space 18. Isolating one module 100 from the space 18 will not compromise the facilities or equipment located in the space 18, either because a backup module 100 may be brought online, either manually or automatically, or because the collection of modules 100 serving the space 18 provides sufficient excess cooling capacity.

A sensor 56 detects and reports the air pressure differential across a filter 58 located in the return duct 24. A pressure differential above a pre-determined level is indicative that the filter 58 requires changing or cleaning. Following filtration, the air in the return duct 24 is drawn across a chilled fluid coil 60, where the air is cooled. The air continues through the blower 12 and exits the module 100 at the quick-connect coupling 26 to provide cooled air to facilities and equipment located external to the module 100 as described above. The chilled fluid coil 60 is supplied with chilled fluid through a chilled fluid loop 62, comprising a supply line 64, return lines 66 and 68, and a valve 70; and terminating at the module container 10 with a pair of quick-connect couplings 72. The chilled fluid directed through the loop 62 is supplied from a source (not shown) external to the module 100. Preferably, the fluid in the loop 62 for such a cooling process is a water or glycol-water solution. However, the fluid in the loop 62 is not limited to a water or glycol-water solution and may be any pumpable fluid that is capable of accepting and releasing cooling through chilled fluid coils. Two sensors 74 and 76 on the supply line 64 and the return line 68, respectively, detect and report the temperature of the fluid directed to and returning from the chilled fluid coil 60.

A key feature of the modular air handling system 100 is the capability of automatically providing a variable volume and temperature of cooled air to facilities or equipment located external to the module 100. The volume of air provided to the facility or equipment located in the space 18 through the supply duct 20 is controlled either by the variable volume control 38 of the blower 12 or by modulating the vane 42 as described above.

Temperature control of the facility serviced by the modular air handling system 100 is provided through the chilled fluid cooling coil 60 and the valve 70. Under normal operating conditions, the entire flow of chilled fluid through the supply line 64 passes through the chilled fluid coil 60 and provides maximum cooling to the air passing through the return duct 24 to the blower 12. If the temperature at the sensor 30 is cooler than a predetermined level, the valve 70 modulates, partially closing the supply of fluid into the valve 70 through the return line 66. Simultaneously, the valve opens the orifice to the bypass line 78. The effect of this valve modulation is that some of the chilled fluid in the supply line 64 is rerouted through the bypass line 78 and the valve 70 to the return line 68, thereby bypassing the chilled fluid coil 60 and correspondingly reducing the capacity of the chilled fluid coil 60 to cool the air being drawn across it. The valve 70 can modulate to the point that the entire flow of fluid through the supply line 64 is directed through the bypass line 78, and no flow is directed through the chilled fluid coil 60. Under such a complete bypass condition, no cooling is provided by the chilled fluid coil 60, and the air drawn through the return duct 24 does not pick up any cooling by the system. Should the temperature detected by the sensor 30 rise above the set temperature, the valve 70 will modulate, directing more flow through the chilled fluid coil 60, until the desired temperature is detected by the sensor 30.

The cooling function provided by the chilled fluid coil 60 is limited by the inventive system to avoid the risk of excessive dehumidification by condensation on the chilled fluid coil 60. A minimum dew point to avoid excessive dehumidification is set for the sensor 34 as a function of the desired temperature and humidity for the space 18. Should the temperature of the air exiting blower 12, as detected by sensor 34, fall below this set minimum dew point, the valve 70 will modulate to stop directing more flow through the chilled fluid 60 and to maintain the air temperature at sensor 34 above the minimum dew point. Under these circumstances where the minimum dew point has been reached, should the temperature at sensor 30 call for more cooling, the variable volume feature of the module 100 as discussed above is activated, with the volume of cooled air being propelled through supply duct 20 increasing until the temperature at sensor 30 is at the target temperature set for the space 18 serviced by the module 100. As less cooling is required in the space 18, the variable volume feature of the module 100 is the first to be deactivated, followed by the modulation of the valve 70 as described above to provide less flow of chilled fluid to the chilled fluid coil 60.

Leads from each of the aforementioned sensors and controls may be directed to a control status panel (not shown) which may be located within the module 100, external to the module container 10, or both. The control status panel may be located at a site many miles from the module container 10. The processing capacity to control each of the aforementioned features resides within the control status panel. The panel may merely display the temperature, flow, and pressure readings as detected by the various sensors. The panel may further indicate the operational status of each blower within the module container, such as displaying a green light for each component currently in operation. Additionally, the panel may contain lights and/or alarms that visually and/or audibly indicate an out-of-range condition as detected by the sensors and as compared against permissible range settings for each particular sensor. Upon detection of an out-of-range condition, the panel status light for the respective component may be changed from green to red, an audible alarm may be activated, and control circuitry may be activated to shut down the affected component. The various temperature and pressure control and alarm points may be reset by the user at the control status panel.

Industrial Applicability

In view of the foregoing, the present invention is advantageously applicable to a modular air handling system for providing a supply of cooled air to remotely situated resources, space, and equipment. The components for cooling the air and for propelling the cooled air to the space and equipment are secured within a transportable module container such that the entire structure can be swapped out should any component fail or should the cooling requirements of the remote space and equipment change. The components of the air handling system are also modular in that each component can be easily removed by non-technical personal and a replacement component easily and quickly plugged back in place so as to avoid or minimize any loss of cooling capacity. All connections of piping, ductwork, and power between the module container and its external environment are in the form of quick-connect couplings to facilitate the easy installation, removal, and replacement of the entire module. The modular plant is particularly useful in providing the cooled air required to air condition a computer room facility and to directly cool computer equipment.

Other aspects, objects and advantages of the present invention can be obtained from a study of the drawings, the disclosure and the appended claims.

We claims:

1. A modular air handling system for producing a supply of cooled air to facilities located external to the modular air handling system, said system comprising:

a module container;

a blower module located within said module container;

a cooling coil module located within said module container; and a primary duct work mechanism at least partially housed within said module container and operatively connected between said blower module and said cooling coil module for transporting air within said module container, wherein the supply of cooled air, having variable volume and temperature, is provided to at least one resource located external to said module container.

2. The system according to claim 1, wherein said module container includes a floor, a ceiling, and one or more walls.

3. The system according to claim 1, wherein said module container is transportable.

4. The system according to claim 1, wherein said blower module includes:

at least one motor;

a fan operatively connected to said at least one motor for propelling air through said primary duct work mechanism; and a housing for supporting said at least one motor and said fan.

5. The system according to claim 4, further comprising a variable volume mechanism disposed within said module container to propel a variable volume of air through said primary duct work mechanism; wherein said variable volume mechanism is selected from the group consisting of at least one variable frequency drive, a scroll cone volume control, and an air bypass duct.

6. The system according to claim 1, wherein said primary duct work mechanism includes an air filtration device.

7. The system according to claim 1, wherein said primary duct work mechanism terminates at a perimeter of said module container with a quick-connect mechanism.

8. The system according to claim 1, wherein said cooling coil module includes:

at least one chilled fluid coil through which a supply of air is directed by said blower module;

a mixing valve for controlling the temperature of said directed supply of air exiting said at least one chilled fluid coil wherein said mixing valve is operatively connected to said at least one chilled fluid coil; and a conduit for transporting chilled fluid through said at least one chilled fluid coil and said mixing valve.

9. The system according to claim 8, wherein said at least one chilled fluid coil is located within said primary duct work mechanism.

10. The system according to claim 9, wherein said at least one chilled fluid coil is in heat exchange relationship with a chilled fluid source located external to said module container.

11. The system according to claim 10, wherein said conduit includes at least one fluid flow loop, wherein each said fluid flow loop includes a supply fluid line and a return fluid line.

12. The system according to claim 11, wherein at least one of said supply and return fluid lines terminates at a perimeter of the module container with a quick-connect mechanism.

13. The system according to claim 1, further comprising sensing controls that are operatively connected to at least one mechanism selected from the group consisting of said blower module, said cooling coil module, and said primary duct work mechanism.

14. The system according to claim 13, wherein said sensing controls detect a plurality of conditions, wherein said plurality of conditions are selected from the group consisting of blower motor speed, air flow rate, air temperature, smoke detection, fluid temperature, and air pressure.

15. The system according to claim 14, further comprising an alarm mechanism to shut down operation of said blower module.

16. A method for producing a supply of cooled air to facilities located external to a modular air handling system that includes a blower module, a cooling coil module, and a primary duct work mechanism at least partially housed within a module container, said method comprising the steps of:

propelling a supply of air through said primary duct work mechanism within said air module container;

cooling said supply of air; and propelling said supply of cooled air, having a variable volume and temperature, to at least one resource located external to said module container.

17. The method according to claim 16, further comprising a step of transporting said module container to and from the site where said module container is to provide said supply of cooled air.

18. The method according to claim 16, wherein said step of propelling said supply of cooled air through said primary duct work mechanism includes propelling said supply of cooled air through said primary duct work mechanism with a fan connected to a motor.

19. The method according to claim 18, wherein said step of propelling said supply of cooled air through said primary duct work includes a step of propelling a variable volume of air through said primary duct work by utilizing a variable volume mechanism disposed within said module container wherein said variable volume mechanism is selected from the group consisting of at least one variable frequency drive, a scroll cone volume control, and an air bypass duct.

20. The method according to claim 16, including a step of filtering said supply of cooled air.

21. The method according to claim 16, including a step of terminating said primary duct work mechanism at a perimeter of said module container with a quick-connect mechanism.

22. The method according to claim 16, wherein said step of cooling said supply of air further includes the steps of:

passing said supply of air through a chilled fluid coil to produce said supply of cooled air;

modulating the temperature of said supply of cooled air exiting said coil by use of a mixing valve operatively connected to a chilled fluid source located external to said module container; and transporting said chilled fluid through a conduit wherein said conduit is fluidly connected to said coil and said mixing valve.

23. The method according to claim 22, wherein said step of transporting said chilled fluid through a conduit includes transporting said chilled fluid through at least one fluid flow loop, wherein each said fluid flow loop includes a supply fluid line and a return fluid line.

24. The method according to claim 23, wherein said step of transporting said chilled fluid through at least one fluid flow loop includes utilizing at least one quick-connect mechanism to terminate at least one of a supply or return fluid line at a perimeter of said module container.

25. The method according to claim 22, wherein said step of transporting said chilled fluid through a conduit includes a step of exchanging heat, wherein said heat is acquired by said chilled fluid in said chilled fluid coil, at a location external to said module container.

26. The method according to claim 16, including a step of detecting an alarm condition wherein said alarm condition is selected from the group consisting of blower motor speed, air flow rate, air temperature, smoke detection, fluid temperature, and air pressure.

27. The method according to claim 26, wherein said step of detecting an alarm condition further includes a step of shutting down said blower module's operation after detecting an alarm condition.

28. A modular air handling system for producing a supply of cooled air to facilities located external to the modular air handling system, said system comprising:

a module container;

a blower module located within said module container;

a cooling coil module located within said module container;

a primary duct work mechanism at least partially housed within said module container and operatively connected between said blower module and said cooling coil module for transporting air within said module container for providing the supply of cooled air to at least one resource located external to said module container; and said primary duct work mechanism including a variable volume mechanism disposed within said module container for propelling a variable volume of air through said primary duct work mechanism thus controlling the volume of cooled air.

29. The system according to claim 28, wherein said variable volume mechanism is selected from the group consisting of at least one variable frequency drive, a scroll cone volume control, and an air bypass duct.

* * * * *